US010357422B2

(12) United States Patent
Spanyer

(10) Patent No.: US 10,357,422 B2
(45) Date of Patent: Jul. 23, 2019

(54) SPINAL SUPPORT DEVICE

(71) Applicant: Jonathon Spanyer, Cleves, OH (US)

(72) Inventor: Jonathon Spanyer, Cleves, OH (US)

( * ) Notice: Subject to any disclaimer, the term of this patent is extended or adjusted under 35 U.S.C. 154(b) by 607 days.

(21) Appl. No.: 14/816,255

(22) Filed: Aug. 3, 2015

(65) Prior Publication Data

US 2016/0030276 A1 Feb. 4, 2016

Related U.S. Application Data

(60) Provisional application No. 62/031,898, filed on Aug. 1, 2014.

(51) Int. Cl.
*A61H 7/00* (2006.01)
*A61H 9/00* (2006.01)

(52) U.S. Cl.
CPC ..... *A61H 9/0078* (2013.01); *A61H 7/001* (2013.01); *A61H 2201/0228* (2013.01); *A61H 2201/1609* (2013.01); *A61H 2201/1623* (2013.01); *A61H 2201/5002* (2013.01); *A61H 2201/5071* (2013.01); *A61H 2203/0456* (2013.01); *A61H 2205/04* (2013.01); *A61H 2205/081* (2013.01)

(58) Field of Classification Search
CPC ..... A61H 9/0078; A61H 2201/0207; A61H 2201/0228; A61G 7/05769; A61G 7/05776
See application file for complete search history.

(56) References Cited

U.S. PATENT DOCUMENTS

| | | | | |
|---|---|---|---|---|
| 4,267,611 | A * | 5/1981 | Agulnick | A61H 9/0071 5/691 |
| 5,070,559 | A | 12/1991 | Pettifer | |
| 5,412,822 | A | 5/1995 | Kelly | |
| 5,893,184 | A * | 4/1999 | Murphy | A47C 7/024 297/229 |
| 6,789,284 | B2 * | 9/2004 | Kemp | A61G 7/05776 5/710 |
| 7,264,601 | B2 | 9/2007 | Liao | |
| 7,536,740 | B1 | 5/2009 | Swartz | |
| 2006/0085919 | A1 * | 4/2006 | Kramer | A47C 7/022 5/713 |
| 2006/0112489 | A1 * | 6/2006 | Bobey | A61B 5/1115 5/655.3 |
| 2007/0094805 | A1 * | 5/2007 | Davis | A61G 7/05769 5/706 |

(Continued)

*Primary Examiner* — Nyca T Nguyen
(74) *Attorney, Agent, or Firm* — Global Intellectual Property Agency, LLC; Daniel Boudwin

(57) ABSTRACT

A spinal support device for alleviating a user's spinal or neck pain. The spinal support device includes a support having a plurality of inflatable bladders positioned on an upper surface thereof. A pump supplies a fluid, such as air or water among others, to the plurality of bladders so as to inflate the same. Each bladder further includes a pressure sensor for monitoring the pressure therein and a valve for sealing the bladder once it has been filled. A control circuit having a microprocessor that communicates with the pump, pressure sensors, and valves is provided, wherein the microprocessor serves to close the valves when the pressure within each bladder has reached a predetermined level. The inflatable bladders may be successively inflated and deflated so as to provide a massaging effect. Further, a heating layer may be disposed over the bladders to provide heat to the user's body.

17 Claims, 3 Drawing Sheets

(56) References Cited

U.S. PATENT DOCUMENTS

| | | | | |
|---|---|---|---|---|
| 2010/0024132 | A1* | 2/2010 | Carlson | A61G 7/05776 5/710 |
| 2010/0205750 | A1* | 8/2010 | McCausland | A47C 27/082 5/713 |
| 2011/0094040 | A1* | 4/2011 | deGreef | A61G 7/05776 5/713 |
| 2012/0079662 | A1* | 4/2012 | Dzioba | A61G 7/05776 5/713 |
| 2012/0311783 | A1* | 12/2012 | Chiang | A47C 21/08 5/421 |
| 2014/0202557 | A1* | 7/2014 | Bullin | A61G 7/05776 137/224 |

* cited by examiner

SPINAL SUPPORT DEVICE

CROSS REFERENCE TO RELATED APPLICATION

This application claims the benefit of U.S. Provisional Application No. 62/031,898 filed on Aug. 1, 2014. The above identified patent application is herein incorporated by reference in its entirety to provide continuity of disclosure.

BACKGROUND OF THE INVENTION

Field of the Invention

The present invention relates to spinal support devices. More specifically, the present invention provides a spinal support device comprising a support having a plurality of inflatable bladders thereon, wherein a user can lie on the bladders and inflate the bladders independently of one another in order to support his or her back and neck. The spinal support device further comprises a control circuit adapted to allow a user to select a desired inflation level for each bladder, wherein the support device automatically inflates the bladders to the selected level.

Many people suffer from chronic back and/or neck pain. As a result, the user may experience discomfort, such as tension, sharp or shooting pains, or a dull constant aching pain in the back and neck. The discomfort may interfere with the person's ability to perform daily activities, rest comfortably, and sleep. Medications may be taken in order to provide relief for back or neck pain, however such medications can be prohibitively expensive and may have a wide variety of undesirable side effects. Further, surgical procedures may be an option for some people, however such procedures can be expensive and painful, requiring a long recovery period. Thus, a support device that is designed to alleviate a person's back or neck pain by restoring the natural curvature of the spine so as to improve flexibility and relieve any pain from compressed nerves and disc-space narrowing is desired.

Devices have been disclosed in the prior art that relate to spinal support devices. These include devices that have been patented and published in patent application publications. Devices in the prior art generally relate to spinal supports or mattresses having one or more inflatable chambers, such as U.S. Pat. Nos. 5,070,559, 4,267,611, 5,412,822, 7,264,601, and 7,536,740.

These prior art devices have several known drawbacks. The devices in the prior art provide spinal supports having inflatable chambers, but fail to disclose a spinal support device having a control circuit that allows for the inflatable chambers to be automatically inflated as selected by the user. Further, the spinal supports of the prior art do not include massaging or heating functionality.

In light of the devices known in the prior art, it is submitted that the present invention substantially diverges in design elements from the prior art and consequently it is clear that there is a need in the art for an improvement to existing spinal support devices. In this regard the instant invention substantially fulfills these needs.

SUMMARY OF THE INVENTION

In view of the foregoing disadvantages inherent in the known types of spinal support devices now present in the prior art, the present invention provides a new spinal support device wherein the same can be utilized for providing convenience for the user when relieving back or neck pain or tension and helping to align the user's spine.

It is therefore an object of the present invention to provide a new and improved spinal support device comprising a support having a plurality of inflatable bladders thereon, wherein a user can lie on the bladders and inflate each bladder to a desired extent so as to provide support for the user's back and neck.

It is another object of the present invention to provide a spinal support device comprising a pump adapted to supply fluid, such as air or water, among others, to the inflatable bladders via a series of tubes.

Another object of the present invention is to provide a spinal support device comprising a plurality of bladders, wherein each bladder includes a valve for sealing the bladder and a pressure sensor for monitoring the pressure within each bladder.

Yet another object of the present invention is to provide a spinal support device comprising a control circuit adapted to receive user input regarding the extent of inflation of the bladders, wherein the control circuit automatically inflates the bladders in accordance with the user's input.

A further object of the present invention is to provide a spinal support device comprising a heating layer adapted to provide heat to a user lying thereon so as to soothe back or neck pain.

Another object of the present invention is to provide a spinal support device that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
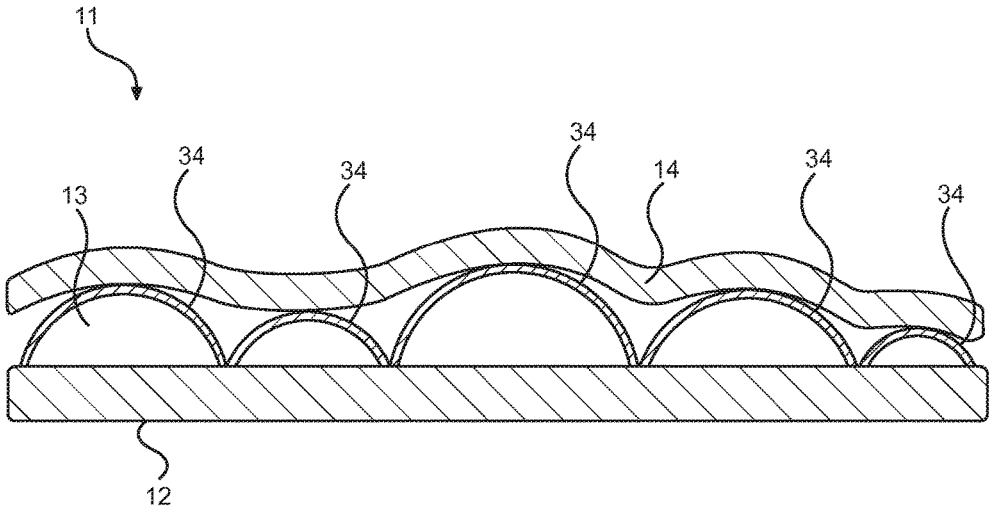
FIG. 1 shows a side cross sectional view of the spinal support device.

Reference is made herein to the attached drawings. Like reference numerals are used throughout the drawings to depict like or similar elements of the spinal support device. For the purposes of presenting a brief and clear description of the present invention, the preferred embodiment will be discussed as used for supporting and aligning a user's spine so as to provide relief from back and neck pain or discomfort. The figures are intended for representative purposes only and should not be considered to be limiting in any respect.

Referring now to FIG. 1, there is shown a side cross sectional view of the spinal support device. The spinal support device 11 comprises a support 12 that preferably comprises a rectangular configuration and is sized so that a person can rest his or her entire body thereon. The support 12 is adapted to be placed on a support surface, such as a floor or a bed. The upper surface of the support 12 comprises a plurality of inflatable bladders 34 thereon. The bladders 34 substantially cover the upper surface of the support 12 so as to form a bed on which a user can lie. In some embodiments, a heating layer 14 is positioned on top of the plurality of bladders 34 so as to selectively provide heat to the user's body to further aid in pain relief. The heating layer 14 includes an electrical heating element therein that can be controlled by the user. The heating layer 14 may further include cushioning or padding depending upon the embodiment.

Figure 2:
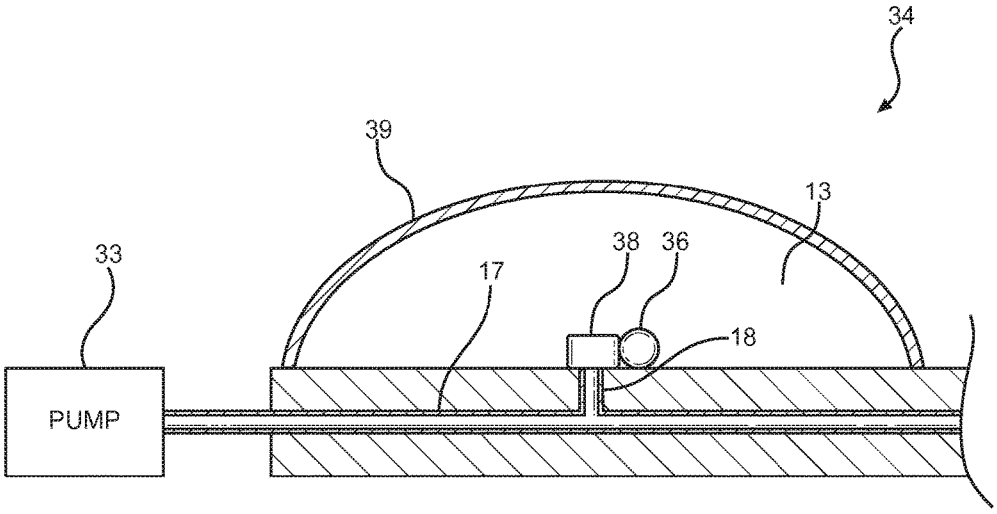
FIG. 2 shows a cross sectional view of a bladder of the spinal support device.

Referring now to FIG. 2, there is shown a cross sectional view of a bladder of the spinal support device. Each bladder 34 comprises a flexible enclosure 39 affixed to the support in an air tight and water tight manner, wherein the bladders 34 comprise a hollow interior volume 13 adapted to be filled with a fluid. Any of various fluids may be used, and in a preferred embodiment the bladders 34 are filled with air. Preferably, the flexible enclosure 39 is rounded or curved when fully inflated so as to provide a comfortable surface on which to lie.

A fluid, such as air or water, is supplied to the plurality of bladders 34 via a pump 33. The pump 33 is preferably external to the support. Fluid is supplied through a series of tubes, wherein a main tube 17 extends through the support to provide fluid communication to a plurality of feed tubes 18. The plurality of feed tubes 18 extend from the main tube 17 so as to supply fluid to each individual bladder 34. Thus, the bladders 34 are separate from one another and are individually filled.

Each feed tube 18 includes a valve 38 that is positioned on the open end thereof, inside of the interior volume 13 of the bladder 34. The valve 38 is preferably an electromechanical valve and is adapted to work in conjunction with a pressure sensor 36. The pressure sensor 36 monitors the pressure within the interior volume 13 of the bladder 34, when the pressure has reached a predetermined level the valve 38 is adapted to close so that the bladder 34 is maintained at a desired pressure.

Figure 3:
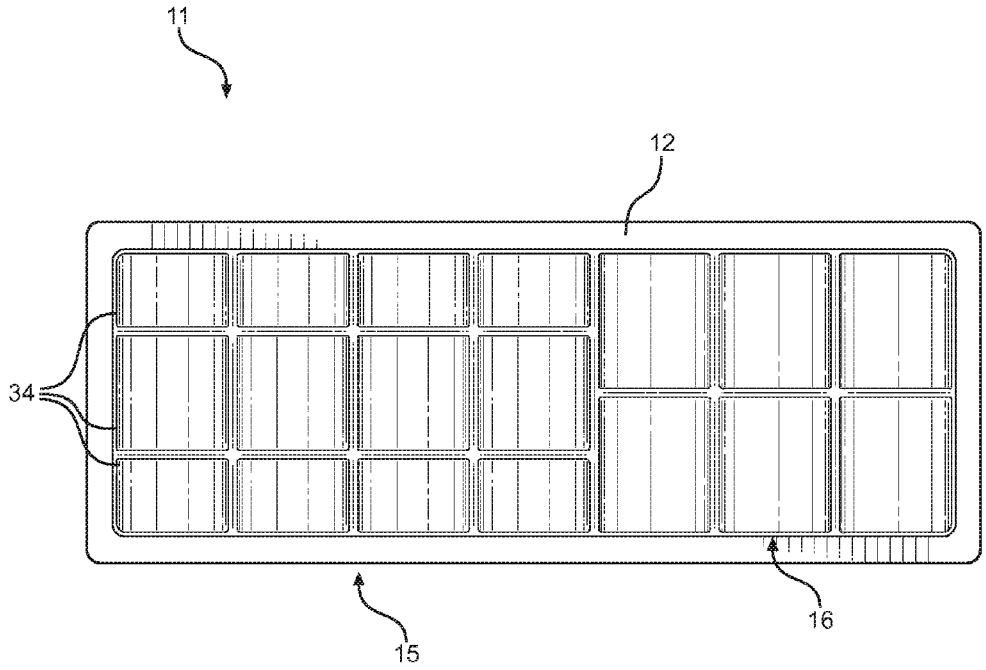
FIG. 3 shows a top-down view of the spinal support device showing the arrangement of the bladders.

Referring now to FIG. 3, there is shown a top-down view of the spinal support device showing the arrangement of the bladders. The plurality of bladders 34 are arranged along the upper surface of the support 12 and preferably substantially cover the same. The bladders 34 are arranged in various configurations depending upon the embodiment. In the illustrated embodiment, a plurality of bladders 34 are upper body bladders 15 and are adapted to support a user's upper body. The upper body bladders 15 are arranged in rows of three, wherein the central bladder is aligned with the user's spine, and the outer bladders support the user's sides. The bladders are further divided into lower body bladders 16, wherein the bladders are arranged in rows of two so as to support the user's legs. In alternate embodiments, the bladders may be arranged in various configurations wherein there are additional bladders in each row.

Figure 4:
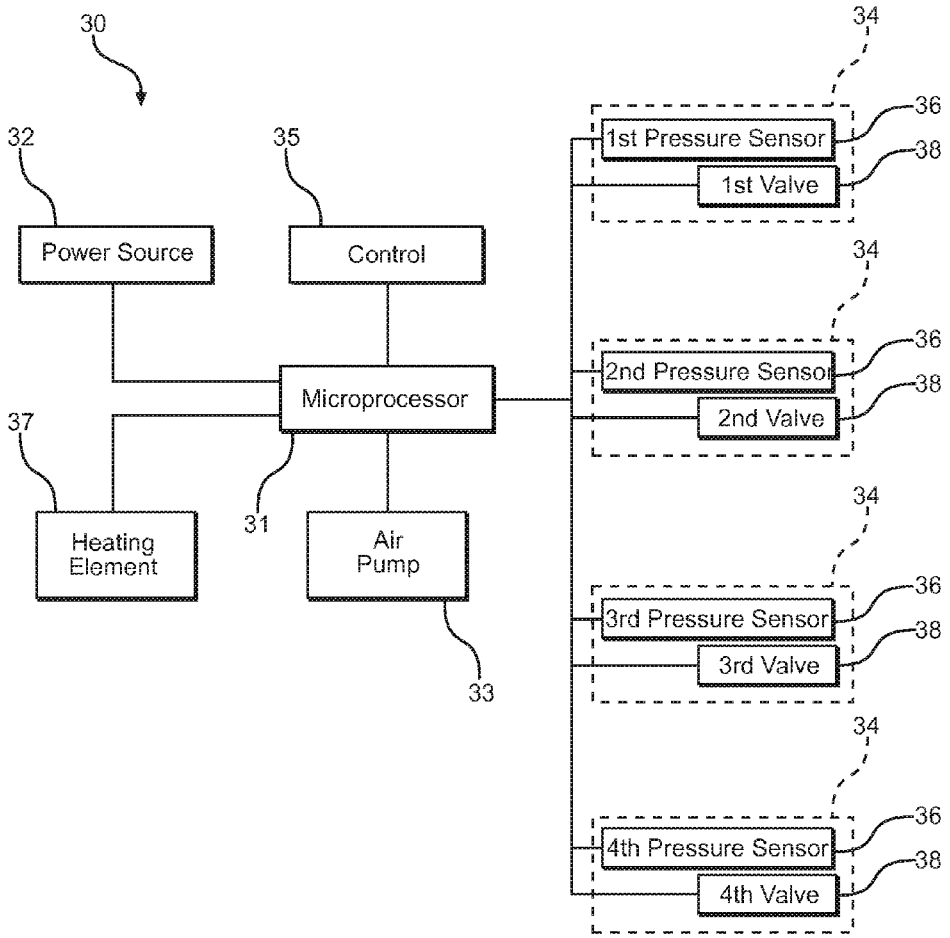
FIG. 4 shows a schematic diagram of the components of the control circuit of the spinal support device.

Referring now to FIG. 4, there is shown a schematic diagram of the components of the control circuit of the spinal support device. The spinal support device 11 further comprises a control circuit 30 adapted to automate the inflation of the bladders 34. The control circuit 30 comprises a microprocessor 31 in electrical communication with a power source 32 and the pump 33. The pump 33 is in fluid communication with the plurality of bladders 34, and the microprocessor 31 is in electrical communication with the valves 38 and pressure sensors 36 within each bladder 34. One or more controls 35 are provided for controlling the operation of the control circuit 30, so that the user can fill the bladders 34 to a desired level. The controls 35 may be integral to the support or may be a separate device. The controls 35 include a plurality of buttons or switches, or may include a touchscreen display, depending upon the embodiment.

In operation, the user can operate the controls 35 in order to inflate each bladder 34 to a desired level of inflation. The user can set the desired pressure within each bladder 34. The microprocessor 31 then signals the pump 33 to fill the bladders 34 with fluid depending upon the user's input. The pressure sensors 36 within each bladder 34 then monitor the pressure within each bladder 34. When the pressure has reached the level set by the user, the microprocessor 31 signals the valve 38 within the bladder 34 to close. The user can increase the pressure in certain bladders 34 so as to provide additional support to problem areas, such as the user's lower back or neck.

In some embodiments, the microprocessor 31 may be programmed to inflate and deflate the bladders 34 in a specific pattern so as to perform a massage-type motion for the user's benefit. Thus, the bladders 34 may successively inflate and deflate on a specific portion of a user's body so as to apply to remove pressure on the user's body.

In some embodiments, the spinal support device further comprises a heating element 37 thereon. The heating element 37 is adapted to provide heat to the user's body so as to provide further comfort or pain relief. The heating element 37 is preferably included in a heating layer disposed on top of the bladders 34. However, the heating element 37 may alternately be incorporated into the bladders 34. The user can select whether heat is provided using the controls 35.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A spinal support device, comprising:

a support having a plurality of bladders arranged on an upper surface thereof, wherein said plurality of bladders are inflatable;

a pump adapted for use in supplying fluid to said plurality of bladders, wherein the pump is operably connected to a main tube extending through the support, wherein the main tube is in fluid communication with a plurality of feed tubes, the plurality of feed tubes are in fluid communication with the plurality of bladders;

wherein each of said plurality of bladders comprises a valve and a pressure sensor;

a control circuit comprising a microprocessor, said pump, said valves, and said pressure sensors, wherein said microprocessor is adapted to communicate with said pump so that said pump provides fluid to said plurality of bladders and wherein said pressure sensors monitor pressure within said plurality of bladders, and wherein said microprocessor controls operation of said valves;

wherein the valve is positioned on an outermost open end of each feed tube of the plurality of feed tubes, wherein the open end is disposed inside an interior volume of each bladder of the plurality of bladders.

2. The spinal support device of claim 1, wherein said plurality of bladders includes upper bladders configured to support an upper body of a user, and lower bladders configured to support a lower body of said user.

3. The spinal support device of claim 2, wherein said lower bladders are arranged as a plurality of rows of two bladders.

4. The spinal support device of claim 2, wherein said upper bladders are arranged as a plurality of rows of three bladders.

5. The spinal support device of claim 4, wherein each row of said plurality of rows of three bladders includes a central bladder and two outer bladders, wherein a length of said central bladder is equal to a length of each of said two outer bladders, wherein a width of said central bladder is greater than a width of each of said two outer bladders.

6. The spinal support device of claim 1, wherein said control circuit includes one or more controls configured to receive a user input.

7. The spinal support device of claim 6, wherein said one or more controls enables a user to input a selected pressure for each bladder of said plurality of bladders.

8. The spinal support device of claim 7, wherein each valve of said valves is configured to close if said pressure of said bladder that includes said valve corresponds to said selected pressure.

9. The spinal support device of claim 1, wherein said plurality of bladders includes a heating layer disposed thereon.

10. The spinal support device of claim 9, wherein said heating layer includes an electrical heating element controllable by a user.

11. The spinal support device of claim 1, wherein each bladder of said plurality of bladders includes a flexible enclosure forming said interior volume, wherein said interior volume is configured to be filled with a fluid.

12. The spinal support device of claim 11, wherein said flexible enclosure includes a rounded or curved configuration.

13. The spinal support device of claim 1, wherein a fluid supplied to said plurality of bladders includes air.

14. The spinal support device of claim 1, wherein a fluid supplied to said plurality of bladders includes water.

15. The spinal support device of claim 1, wherein each valve of said valves is configured to operate in conjunction with a corresponding pressure sensor of said pressure sensors.

16. The spinal support device of claim 1, wherein one or more controls are operably connected to said control circuit, wherein said one or more controls includes a touchscreen display.

17. The spinal support device of claim 1, wherein said microprocessor is configured to selectively and successively inflate and deflate said plurality of bladders, such that said plurality of bladders is configured to apply a pressure to and remove said pressure from a body of a user to massage said body of said user.

* * * * *